United States Patent [19]

Greczin

[11] 3,930,385

[45] Jan. 6, 1976

[54] SELF BALANCING TABLE

[76] Inventor: John C. Greczin, 7312 School Lane, Philadelphia, Pa. 19126

[22] Filed: Jan. 20, 1975

[21] Appl. No.: 542,544

[52] U.S. Cl. ..... 66/125 R; 242/131; 242/7.22; 57/13

[51] Int. Cl.[2] ..... D04B 27/10

[58] Field of Search ..... 66/125 R, 9 A, 8; 242/131, 242/131.1, 7.22, 7.21; 57/1 R, 3, 6, 13, 14, 15, 59

[56] References Cited

UNITED STATES PATENTS

| | | | |
|---|---|---|---|
| 3,651,629 | 3/1972 | Webster | 57/13 |
| 3,789,594 | 2/1974 | Rees | 242/7.22 X |
| 3,848,433 | 11/1974 | Greczin | 66/125 R |

FOREIGN PATENTS OR APPLICATIONS

| | | | |
|---|---|---|---|
| 1,947,727 | 4/1971 | Germany | 66/125 R |

*Primary Examiner*—W. C. Reynolds
*Assistant Examiner*—Andrew M. Falk
*Attorney, Agent, or Firm*—Karl L. Spivak, Esq.; Alfred Stapler, Esq.; Gerard J. Weiser, Esq.

[57] ABSTRACT

In a circular knitting machine, a self-balancing, circular bobbin table which has formed therein a circular groove within which a plurality of balls freely roll to dynamically balance the table as it is rotated during the knitting operations.

11 Claims, 3 Drawing Figures

FIG. 2
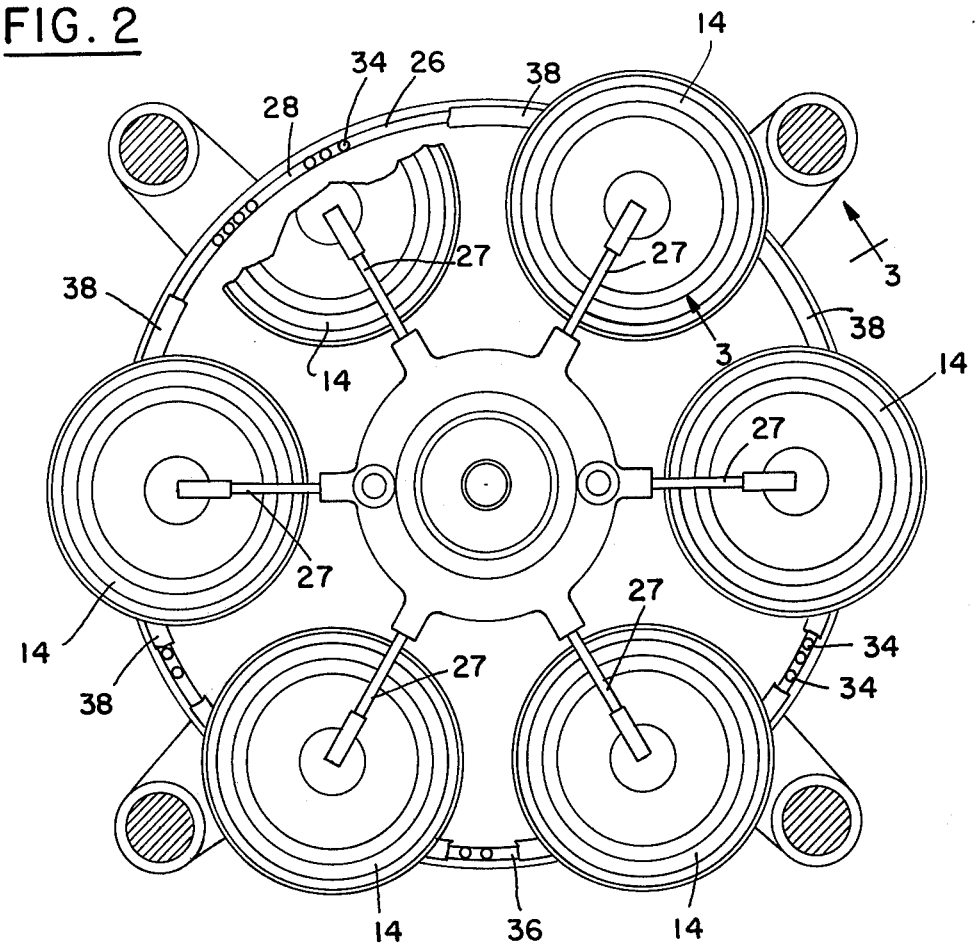
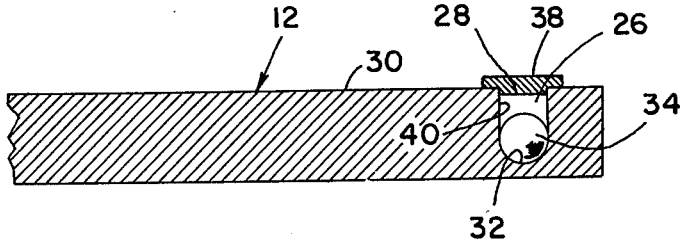
FIG. 3

SELF BALANCING TABLE

BACKGROUND OF THE INVENTION

The present invention relates generally to the knitting machine art, and more particularly, is directed to a circular knitting machine having a self-balancing bobbin table.

Circular knitting machines of the multi-feed type include means to mount a plurality of yarn supply bobbins thereon, at least one supply bobbin being provided for each feed. The bobbins are mounted outwardly from the central machine axis and may be arranged at the outer end of radially oriented arms which radiate outwardly from a central mounting hub which is concentric with and which rotates about the axis of the machine. Optionally, the yarn supply bobbins may be mounted upon a solid, disc like table similar to that disclosed in my copending patent application Ser. No. 283,787, now U.S. Pat. No. 3,848,433. Due to the speed of rotation of prior art bobbin mounting means, any unbalance in the system construction will result in unwanted vibration, the imposition of unbalanced forces or other unwanted unbalanced conditions which interfere with quiet, trouble-free operation and which can result in undue bearing wear, fatigue cracks and other mechanical failures.

SUMMARY OF THE INVENTION

The present invention relates generally to circular knitting machines of the type incorporating solid bobbin tables, and more particularly, is directed to a bobbin table incorporating dynamic balancing construction.

The present invention includes a solid bobbin table of generally flat, disc like configuration which includes a central aperture for mounting the bobbin table in concentric relation to the needle cylinder of a circular knitting machine. The bobbin mounting table includes a circular groove positioned near the outer periphery of the table and a plurality of balls which are free to roll within the grooves to balance the bobbin table when it is rotated at high speed. A cover of wire fabric or other lightweight, strong, thin material is positioned over the circular groove to retain the balls within the groove during rotation and to facilitate access to the groove to either add or subtract the number of balls positioned within the groove as may be desired or necessary to dynamically balance the table when the machine is in operation.

It is therefore an object of the present invention to provide an improved, circular knitting machine including a balanced, solid bobbin table.

It is another object of the present invention to provide a novel self-balancing bobbin table for a circular knitting machine including ball means for dynamically balancing the table.

It is another object of the present invention to provide a novel self balancing bobbin table for use with a circular knitting machine including a peripherally positioned circular groove and a plurality of balls which are free to roll within the groove to compensate for any unbalance in the table construction when the table is rotated at high speed.

It is another object of the present invention to provide a novel bobbin table for use with circular knitting machines wherein the table includes circular groove means, ball means which roll within the groove means and cover means to retain the ball means within the groove means when the table is rotated at high speed.

It is another object of the present invention to provide a novel self-balancing bobbin table that is inexpensive in manufacture, simple in design and trouble free when in operation.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 2 is a sectional view on reduced scale taken along Line 2—2 of FIG. 1, looking in the direction of the arrows.

FIG. 3 is an enlarged, cross sectional view taken along Line 3—3 of FIG. 2, looking in the direction of the arrows.

DESCRIPTION OF THE PREFERRED EMBODIMENT OF THE INVENTION

Figure 1:
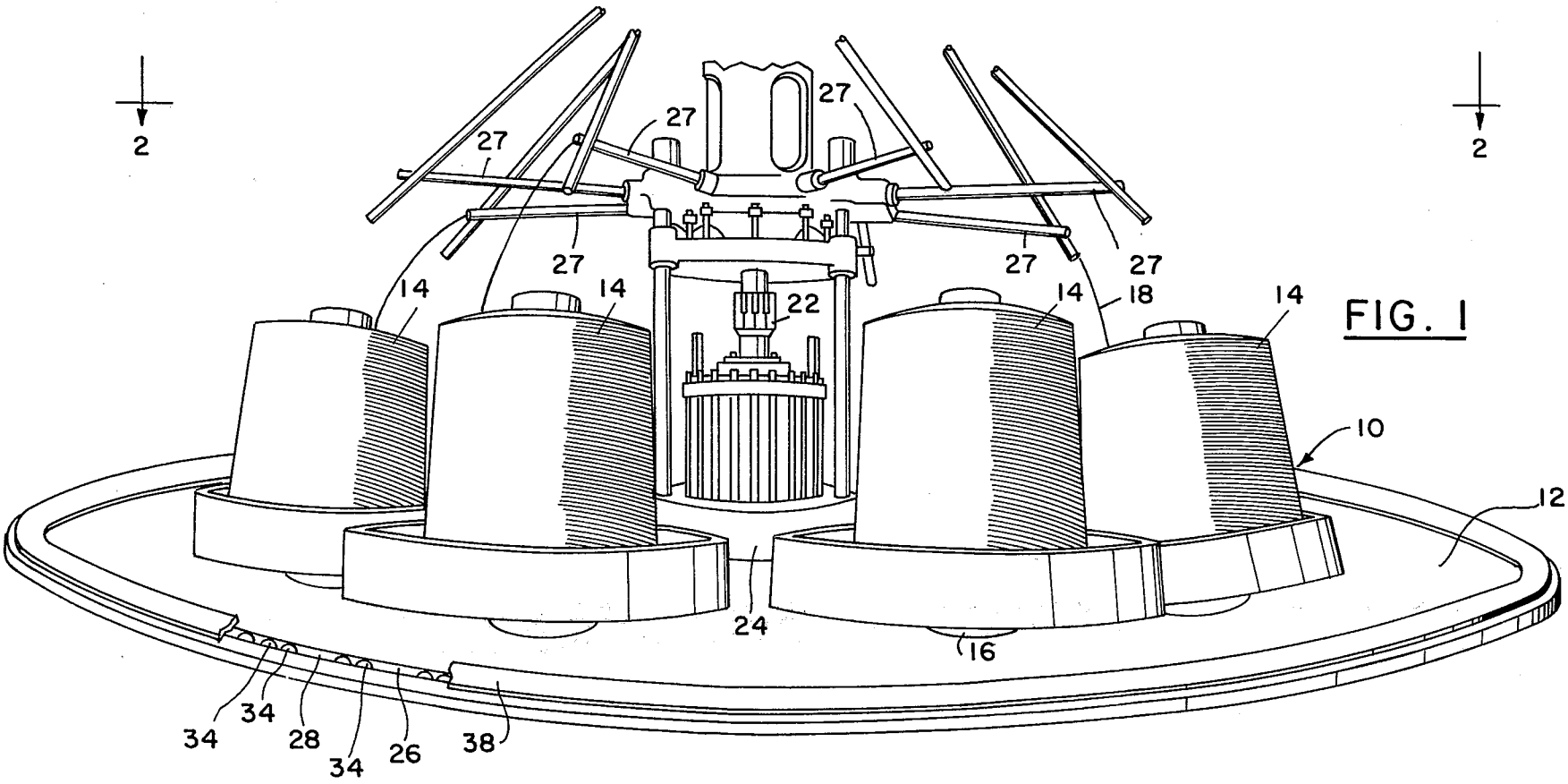
FIG. 1 is a perspective view of a portion of a circular knitting machine showing the use of the present invention, portions of which are broken away to expose details of interior construction.

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a portion of a circular knitting machine 10 of the type generally set forth in my previous patents, U.S. Pat. Nos. 2,257,828 and 3,543,280 wherein a solid bobbin mounting table is employed similar to that disclosed in my previous patent, U.S. Pat. No. 2,848,433. The present invention will be described in conjunction with the type of circular knitting machine that is commonly employed to knit a tubular reinforcing fabric over a length of hose. However, it will be appreciated that the invention is not so limited and the bobbin mounting table described can be equally employed for use with other types of circular knitting machines.

The knitting machine 10 with the exception of the bobbin mounting table 12 is conventional, is fully described in my previous patents and so need not be fully described at this time. Suffice it to say that a plurality of yarn wound bobbins 14 are mounted upon the table 12 through suitable mounting blocks 16 to feed yarn 18 to the knitting needles (not shown) through the yarn guides 20. The knitting needles reciprocate within the usual grooves provided in the needle cylinder 20 and the needle stem 22 to knit a tubular fabric in well known manner. The bobbin mounting table 12 is rotated at relatively high speed by the machine motor (not shown) in the usual manner to facilitate the knitting operations.

The bobbin mounting table 12 may be fabricated of solid, disc-shaped configuration as illustrated and may be constructed of a suitable sturdy material, for example, aluminum plate of uniform three-quarter inch thickness. The bobbin mounting table 12 may also be fabricated in the form of an annular ring (not illustrated) with suitable mounting spokes (also not illustrated) which radiate from the central hub 24 if so desired, to provide adequate provision to receive a plurality of balls to dynamically balance the table as hereinafter more fully set forth.

Referring now to FIGS. 1, 2 and 3, I show a solid bobbin mounting table 12 conventionally mounted upon a circular knitting machine 10 to facilitate rotation thereabout in well known manner. The table 12 is provided with a circular groove means 26 which is positioned near the outer periphery 25 of the table 12. The groove 26 may be machined or otherwise formed in the table construction. Preferably, the groove 26 opens upwardly to form a circular opening 28 which is flush with the top surface 30 of the bobbin mounting table 12. In a preferred embodiment, I have found that a groove five-eighths of an inch in depth and five-eights of an inch in width to be suitable for this purpose. As best seen in FIG. 3, the circular groove 26 terminates downwardly in a rounded bottom surface 32 to facilitate circular rolling of a plurality of balls therein. In the event the bobbin table is in the form of an annular ring as above set forth, the circular groove 26 would be similarly formed in the annulus.

As seen in FIGS. 2 and 3, ball means 34 comprising a plurality of hardened steel balls are positioned within the circular groove 26 for dynamic table balancing purposes. The balls should be of suitable size to readily fit within the groove 26 and to be freely movable within the annular path defined by the interior of the groove. A sufficient number of balls 34 should be employed to dynamically balance the bobbin mounting table as it is rotated at high speed. Sufficient space 36 should be left free, that is unencumbered, by the presence of balls 34, to allow the balls 34 great freedom in movement about the annular path defined by the groove 26. In this manner, when the bobbin mounting table 12 is rotated at high speed, the balls 34 can freely move along the path defined by the groove 26 to approach the desired equilibrium position to compensate for any unbalance in the system.

In a preferred embodiment, the radius of the balls 34 is substantially equal to the radius of the bottom 32 of the groove to permit rolling contact thereover.

As hereinbefore set forth, the circular groove 26 opens upwardly to provide a circular groove opening 28 into which the plurality of balls 34 can readily be fed. More or fewer balls can be employed as necessary and as determined upon field testing of the apparatus to assure that sufficient movable weight in the form of the balls 34 is present for optimum dynamic balancing of the bobbin mounting table 12. After a sufficient number of balls 34 is placed within the circular groove 26, a cover 38 is affixed to the surface 30 of the bobbin mounting table 12 to completely cover the circular groove opening 28 in a manner to retain the balls 34 within the circular groove 26. The cover 38 may be secured to the bobbin mounting table surface 30 in any well known manner such as by employing suitable fasteners (not shown) affixed directly to the bobbin mounting table 12 in a manner to secure the cover 38 under all conditions of use. The cover 38 may be fabricated of relatively light weight expanded metal, sheet aluminum, wire fabric or the like of sufficient strength to prevent balls from exiting from the circular groove 26 when the bobbin mounting table is rotated at high speed. Of course, due to centrifugal forces generated by table rotation, all of the forces imposed by the balls 34 will be directed radially outwardly against the outer side 40 of the circular groove 26 and normally, no forces will be imposed upwardly against the cover 38. However, it is conceivable that the balls 34 may bunch together and tend to pyramid within the groove 26 and the fasteners (not shown) affixing the cover 38 to the top surface 30 of the bobbin mounting table 12 should be strong enough to resist the possible imposition of any such forces.

Upon high speed rotation of the bobbin mounting table (or annular ring if used), the balls 34 will tend to position themselves within the circular groove 26 in the most advantageous location to compensate for any dynamic unbalance within the system. Thus the balls 34 automatically position themselves without any manual operations to eliminate vibration, chatter, wear or other conditions directly or indirectly caused by system unbalance.

Although I have described my invention with a certain degree of particularlity, it is understood that the present disclosure has been made only by way of example and that numerous changes in the details of construction and the combination and arrangement of parts may be resorted to without departing from the scope of the invention.

I claim:

1. A self-balancing table in a circular knitting machine of the type including a rotating bobbin mounting table, the combination of A. groove means provided in the table to form a path adapted to retain movable weight means therewithin,

1. said groove means being circular in planar configuration;

B. weight means movable within the groove means to dynamically balance the table,

1. said weight means including a plurality of similarly configured weights; and C. cover means overfitting the groove means to retain the weight means within the groove means when the bobbin mounting table is rotated.

2. The self balancing table of claim 1 wherein the table is formed to a generally flat, disc-like configuration having a circular peripheral edge and wherein the groove is positioned near the peripheral edge.

3. The self balancing table of claim 2 wherein the table is a solid disc.

4. The self balancing table of claim 1 wherein the groove means include a circular groove formed in the table near the outer periphery thereof, said groove having an open top in the form of a circular opening.

5. The self balancing table of claim 4 wherein the groove terminates downwardly in a rounded bottom surface.

6. The self balancing table of claim 5 wherein the width of the groove equals the depth of the groove.

7. The self balancing table of claim 5 wherein the weight means comprise a plurality of balls, the said balls being of diameter to easily move within the circular groove.

8. The self balancing table of claim 7 wherein the radius of the balls is substantially equal to the radius of the rounded bottom groove surface to facilitate rolling contact therebetween.

9. The self balancing table of claim 7 wherein the cover means include a cover secured to the table, said cover being configured to overfit and close the said open top of the groove to prevent the balls from exiting the groove when the bobbin mounting table is rotated at high speed.

10. The self balancing table of claim 9 wherein the cover is fabricated of relatively light weight material relative to the weight of the table.

11. The self balancing table of claim 10 wherein the number of balls employed for dynamic balancing purposes is less than the number that would be required to completely fill the groove.

* * * * *